US005934331A

United States Patent [19]

Earl

[11] Patent Number: 5,934,331

[45] Date of Patent: Aug. 10, 1999

[54] FLOOR DRAIN ADAPTER

[76] Inventor: Daniel L. Earl, 4813 South Long Lake Dr., Portage, Mich. 49002

[21] Appl. No.: 08/789,138

[22] Filed: Jan. 28, 1997

[51] Int. Cl.[6] ..... F16L 55/10

[52] U.S. Cl. ..... 138/89; 138/110; 138/103; 174/81; 137/362

[58] Field of Search ..... 138/89, 110, 120, 138/106, 108, 103; 137/362; 285/179; 174/81; D23/235, 261; 52/169.5

[56] References Cited

U.S. PATENT DOCUMENTS

| | | | |
|---|---|---|---|
| 765,131 | 7/1904 | Croswell | 4/652 |
| 964,954 | 7/1910 | Coles | 4/255.08 |
| 1,504,126 | 8/1924 | Lassel | 137/362 |
| 1,523,501 | 1/1925 | Vibber | 174/81 |
| 1,774,151 | 8/1930 | Olley | 174/81 |
| 1,879,581 | 9/1932 | Stougaard | 104/52 |
| 2,234,640 | 3/1941 | Austin, Jr. | 174/81 |
| 2,686,216 | 8/1954 | Appleton et al. | 174/81 |
| 2,865,981 | 12/1958 | Budnick | 174/81 |
| 2,921,599 | 1/1960 | Fleischman | 137/140 |
| 2,926,212 | 2/1960 | Appleton | 174/81 |
| 2,946,560 | 7/1960 | Ferm | 285/134.3 FT |
| 3,297,064 | 1/1967 | More et al. | 141/383 |
| 3,357,429 | 12/1967 | Folkman et al. | 604/324 |
| 4,023,833 | 5/1977 | Wellard | 285/179 |
| 4,109,939 | 8/1978 | Roberts | 285/8 |
| 4,181,330 | 1/1980 | Kojima | 285/179.1 |
| 4,722,556 | 2/1988 | Todd | 285/12 |
| 4,758,027 | 7/1988 | Todd | 285/148.23 |
| 4,796,926 | 1/1989 | Rapsilver | 285/181 |

*Primary Examiner*—Patrick Brinson

[57] ABSTRACT

A floor drain adapter comprises a floor drain cover having an opening communicated to the floor drain and an elbow disposed on the cover and terminating in an open end. A rubber collar is provided about the open end in a manner to define an opening to receive one or more rubber sheathed drain hoses and in which one or more drain hoses are maintained in position by frictional engagement with the collar and with one another when more than one drain hose is present, even when a fluid, such as water, is drained through the hose(s) at high rates. The drain cover typically includes drain slots to drain a fluid on the floor and may include a vent opening above the cover as may be required by building code.

13 Claims, 1 Drawing Sheet

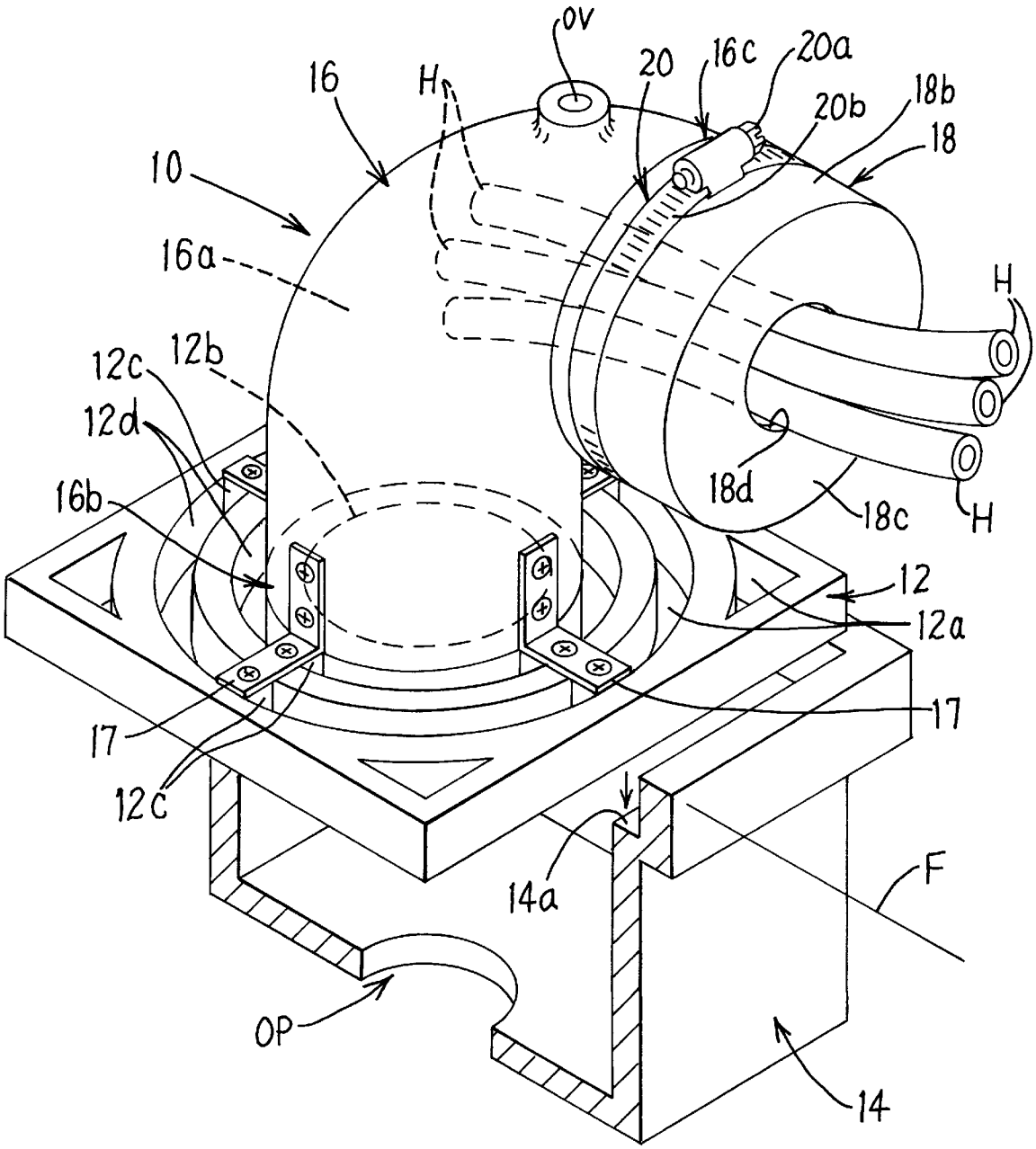
OV
16
H
20
16c
20a
20b
18b
18
10
16a
H
12c
12b
12d
16b
18d
18c
H
12
12a
17
17
12c
14a
F
OP
14

FLOOR DRAIN ADAPTER

FIELD OF THE INVENTION

The present invention relates to a floor drain adapter for connection to one or more drain hoses from machines, such as for example ice cream making machines, that drain water on a continuous or discontinuous basis.

BACKGROUND OF THE INVENTION

Ice cream making machines and other water cooled machines in restaurants typically have one more drain hoses or conduits extending therefrom that drain water from a refrigeration unit of the machine into a floor drain. In the past, one or more water drain hoses have been inserted in a cone shaped rubber adapter inserted in the floor drain to this end. However, the drain hose(s) can be become dislodged from the floor drain by forces on the drain hose(s) when water drains therefrom especially at high flow rates.

An object of the present invention is to provide a floor drain adapter for communicating one or more drain hoses to a floor drain in a manner that overcomes the disadvantages of prior drain hose connection techniques.

SUMMARY OF THE INVENTION

A floor drain adapter pursuant to an embodiment of the present invention comprises a floor drain cover having one or more openings communicated to the floor drain and a tubular drain member, such as for example only, a drain elbow, disposed on the cover and terminating in an open drain end proximate the drain cover and an open end remote from the drain cover. The floor drain cover may be configured to reside on a floor drain compartment permanently embedded in the floor. A collar is provided about the remote open end of the drain member or elbow in a manner to define an opening sized to receive one or more drain hoses and in which one or more drain hoses are maintained in position by frictional engagement with the collar and with one another when more than one drain hose is present, even when a fluid, such as water, is drained through the hose(s) at high rates. The drain cover typically includes drain slot openings disposed about the tubular drain member to drain any fluid that may be present on the floor and a vent opening as may be required by building codes.

DESCRIPTION OF THE DRAWINGS

The Figure is a perspective view of the floor drain adapter in accordance with an embodiment of the present invention residing on a permanent floor drain compartment embedded in the floor.

DESCRIPTION OF THE INVENTION

Referring to the Figure, a floor drain adapter 10 pursuant to an embodiment of the present invention is shown residing on a permanent metal or plastic floor drain compartment 14 embedded in the building floor F. The floor drain adapter comprises a rigid floor drain cover 12 of size and shape to reside on a horizontal lip 14*a* of the floor drain compartment 14 that communicates to the floor drain opening OP therebelow. The floor drain opening OP in turn communnicates to a sewer line, septic field or other conventional waster water disposal system (not shown).

The floor drain cover 12 includes a plurality of arcuate drain slot openings 12*a* that drain water that may be present on the floor to the compartment 14 and then to the opening OP. The slot openings 12*a* may be concentrically disposed about a central circular cover opening 12*b* that is in registry with and communicates to the inner drain passage 16*a* of a rigid drain adapter elbow 16. Alternately, additional concentric slot openings 12*a* can be provided radially inwardly on the cover 12 as far as dimensions will permit so as to be located beneath the drain adapter elbow 16 such that central opening 12*b* is replaced by one or more arcuate drain slot openings 12*a* residing beneath and communicating to the elbow drain passage 16*a*. The central cover opening 12*b*, or alternately the additional drain slot(s) 12*a* disposed on the cover 12 beneath the elbow 16, allow water (or other fluid) discharged to the drain adapter elbow 16 by the drain hoses H to be drained to the compartment 14 and then the opening OP for disposal. A typical diameter of cover drain opening 12*b* may be approximately 4 inches for example only. A typical radial dimension of the drain slot openings 12*a* may be about 0.5 inch for example only with the slot openings extending circumferentially relative to the elbow end 16*b* except as interrupted by the regions where radial ribs 12*c* are present on the cover 12.

The tubular drain member or elbow 16 is disposed on the cover 12 with its inner drain passage 16*a* in registry with and communicated to the cover opening 12*b*, or overlying and communicating with the drain slot opening(s) 12*a* disposed in the cover 12 beneath the elbow 16 in the alternative embodiment, to this end. The elbow can be affixed on the cover 12 by a plurality of circumferentially spaced apart L-fastening metal brackets 17 that are screwed to radially extending ribs 12*c* of the cover 12 and also to the elbow end 16*b* as shown. The radial ribs 12*c* are molded integrally with the drain cover 12 to interconnect the concentric arcuate cover regions that define the drain slot openings 12*a*. Alternately, the elbow 16 can be molded or otherwise formed integrally with the cover 12 to provide a one piece unit.

The cover 12 and elbow 16 typically are made of molded plastic material conventionally used in building plumbing components. The drain elbow 16 typically comprises a conventional plumbing elbow commonly used in building plumbing and having open opposite ends 16*b*, 16*c*, the elbow 16 typically having an inner diameter of approximately 4 inches or other desired diameter. The open drain end 16*b* is disposed proximate the drain cover 12 while the open end 16*c* is disposed remote from the drain cover 12.

The elbow 16 includes generally horizontally oriented open end 16*c* remote from the end 16*b* disposed proximate the cover 12. Elbow end 16*c* is partially covered by a rubber collar 18. The elbow may include a vent opening OV above the cover 12 as shown if required by local building code.

The rubber collar 18 (e.g. a 4 inch QWIK CAP collar available from Fernco Inc.) is disposed on the open remote end 16*c* of the elbow 16 and defines a collar opening 18*a* to receive one or more drain hoses H each extending from a machine, such as an ice cream making machine and the like, that drains water or other fluid in continuous or discontinuous manner. The hoses H extend through the collar opening 18*a* and open end of the elbow 16 and into the elbow drain passage 16*a*. The collar 18 is held on the open end of the elbow 16 by a conventional ring clamp or connector 20 that is tightened about the collar 18 by turning the adjustment screw 20*a* to engage slots 20*b* of the clamp.

The collar opening 18*a* is sized to receive one or more drain hoses H as shown. In particular, the end of each drain hose H is inserted in the collar opening 18*a* to position the hose end(s) in the drain passage of the elbow 16 to drain water (or other fluid) therein. The collar opening 18*a* may be a chosen or selected diameter for receiving and accommodating a desired number of drain hoses H each for example having an outer diameter of 0.5 inch. For example only, an opening 18*a* with a diameter of 4 inches may be used to receive up to ten such drain hoses. A larger or smaller diameter opening 18*a* may be used to receive and maintain in position a larger or smaller number of drain hoses.

The collar 18 typically includes an elongated tubular region 18*b* that is slip fit over the open remote end of the elbow 16. The tubular region 18*b* is clamped on the elbow end 16*c* by the clamp 20. The collar 18 also includes a radially extending annular end 18*c* having a cylindrical inner surface 18*d* that defines the hose-receiving collar opening 18*a*.

The drain hoses H typically have at least an outer rubber sheath that frictionally engages the surface 18*d* of the rubber collar 18 when the ends of the hoses H are inserted in the collar opening 18*a* as shown. The rubber sheathed hose(s) H are maintained in position by frictional engagement with the appropriately sized collar surface 18*d* and with one another when more than one drain hose H is present as shown in the Figure. The hoses H can be maintained in position by such frictional engagement in this manner even when a fluid, such as water, is drained through the hose(s) at high rates.

The above invention has been described in connection with certain particular embodiments thereof. It is understood that changes and modifications may be made to the embodiments without departing from the spirit and scope of the present invention as set forth in the appended claims.

What is claimed:

1. A floor drain adapter combined with a building floor drain to drain fluid from one or more fluid drain hoses, comprising a drain cover positioned on the floor drain and having at least one drain opening communicated to the building floor drain, a tubular drain member disposed on the cover and having a fluid drain passage therein communicating to said drain opening, said tubular member terminating in an open end, and a collar disposed on the open end in a manner to define an opening to receive one or more fluid drain hoses and in which said one or more drain hoses are maintained in position by frictional engagement with the collar and with one another when more than one fluid drain hose is present.

2. The adapter of claim 1 wherein the tubular drain member is an elbow.

3. The adapter of claim 2 wherein the elbow is fastened to the cover.

4. The adapter of claim 2 wherein the elbow is integral with the cover.

5. The adapter of claim 1 wherein the elbow includes a vent opening above the cover.

6. The adapter of claim 1 wherein the cover includes said drain opening disposed beneath said tubular member and one or more drain slot openings disposed about said tubular member to drain fluid on the floor.

7. The adapter of claim 1 wherein the collar is rubber to frictionally engage rubber sheathed drain hoses.

8. The adapter of claim 2 wherein the collar includes a tubular region slipped over the open end of the elbow.

9. The adapter of claim 8 including clamp means for clamping the tubular region on the elbow.

10. The adapter of claim 8 wherein the collar includes a radially extending region having a cylindrical surface defining said collar opening.

11. The adapter of claim 10 wherein the opening is sized in diameter to frictionally receive at least one drain hose.

12. A floor drain adapter comprising a drain cover having at least one drain opening communicated to a floor drain, a tubular drain member disposed on the cover and communicating to said drain opening, said tubular member having a vent opening above the drain cover and terminating in an open end, and a collar disposed on the open end in a manner to define an opening to receive one or more drain hoses and in which said one or more drain hoses are maintained in position by frictional engagement with the collar and with one another when more than one drain hose is present.

13. A floor drain adapter comprising a drain cover having a drain opening communicated to a floor drain in a floor, a tubular drain member disposed on the cover with said drain opening disposed beneath and communicated to said tubular member, said drain cover having one or more drain slots disposed about the drain opening exterior of the tubular member to drain fluid on the floor, said tubular member terminating in an open end, and a collar disposed on the open end in a manner to define an opening to receive one or more drain hoses and in which said one or more drain hoses are maintained in position by frictional engagement with the collar and with one another when more than one drain hose is present.

* * * * *